US006447848B1

(12) United States Patent
Chow et al.

(10) Patent No.: US 6,447,848 B1
(45) Date of Patent: Sep. 10, 2002

(54) NANOSIZE PARTICLE COATINGS MADE BY THERMALLY SPRAYING SOLUTION PRECURSOR FEEDSTOCKS

(75) Inventors: Gan-Moog Chow, Singapore (SG); Lynn K. Kurihara, Alexandria, VA (US); T. Danny Xiao, West Willington, CT (US); Peter R. Strutt; Christopher W. Strock, both of Storrs, CT (US); Raymond A. Zatorski, East Hampton, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/106,456

(22) Filed: Jun. 30, 1998

Related U.S. Application Data

(63) Continuation-in-part of application No. 09/019,061, filed on Feb. 5, 1998, now Pat. No. 6,025,034, which is a continuation of application No. 08/558,133, filed on Nov. 13, 1995, now abandoned.

(51) Int. Cl.[7] ..... C23C 4/04

(52) U.S. Cl. ..... 427/446; 427/450; 427/452; 427/453; 427/455; 427/456

(58) Field of Search ..... 427/446, 450, 427/452, 453, 455, 456

(56) References Cited

U.S. PATENT DOCUMENTS

| | | | | |
|---|---|---|---|---|
| 4,982,067 A | | 1/1991 | Marantz et al. | 219/121.47 |
| 5,032,568 A | | 7/1991 | Lau et al. | 505/1 |
| 5,413,821 A | | 5/1995 | Ellis et al. | 427/576 |
| 5,609,921 A | | 3/1997 | Gitzhofer et al. | 427/446 |
| 5,688,565 A | | 11/1997 | McMillan et al. | 427/565 |
| 5,863,604 A | * | 1/1999 | Hunt et al. | 427/455 |
| 6,277,448 B2 | * | 8/2001 | Strutt et al. | 427/452 |

FOREIGN PATENT DOCUMENTS

WO WO 97/18341 * 5/1997

OTHER PUBLICATIONS

Hawley's Condensed Chemical Dictionary, Twelfth. Edition, Van Nostrand Reinhold Company, 1993, pp. 1250 and 1253. (no month date).*

Hull PJ et al: "Synthesis of Nanometer–scale silver crystallites via a room–temperature electrostatic spraying process", Advanced Materials, vol. 9, No. 5, Apr. 1, 1997, pp. 413–417.

Vieu C et al: "Gold nanograins deposited from a liquid metal ion source" Microelectronic Engineering, vol. 35, No. 1; Feb. 1, 1997, pp. 349–352.

Chen CH et al: "Effects of Additives in Electrospraying for Materials Preparation", Journal of the European Ceramic Society, vol. 18, No. 10; Sep. 1, 1998, pp. 1439–1443.

*Primary Examiner*—Katherine A. Bareford
(74) *Attorney, Agent, or Firm*—John J. Karasek; George A. Kap

(57) ABSTRACT

Thin films or coatings having a thickness of about 100 nanometers or larger are made of nanostructured particles which have a particle size less than 100 nm (i.e. 0.1 micron) by thermally spraying a solution of a liquid coating precursor feedstock onto a substrate to form the film or coating. By thermal spraying with different precursor feedstock solutions, coatings can be made with more than one layer. Also, by varying the composition of the precursor feedstock during spraying, a fine composition gradient coating can be formed which is made up of the same small nanoparticle size particles of less than, 100 nm. Many combinations of materials can be co-deposited and by applying an external energy source either during the coating process or during post deposition, the resulting coating can be modified.

16 Claims, 2 Drawing Sheets

FOREIGN PATENT DOCUMENTS

Lopez S et al: "Spray Pyrolysis Deposition of SN2S3 Thin Films" Semiconductor Science and Technology, vol. 11, No. 3, Mar. 1, 1996, pp. 433–436.

Correa–Lozano B et al: "Physicochemical properties of SNO2–SB205 Films prepared by the spray pyrolysis technique", Journal of the Electrochemical Society, vol. 143, No. 1, Jan. 1, 1996, pp. 203–209.

Karthikey ANJ et al: "Nanomaterial Deposits Formed by DC Plasma Spraying of Liquid Feedstocks" Journal of the American Ceramic Society, vol. 81, No. 1, Jan. 1998, pp. 121–128.

Tikkanen, J et al: "Characteristics of the liquid flame spray process", Surface and Coatings Technology 90, (1997) pp. 210–216 (No month date).

Karthikey AN J et al "Nanomaterial Powders and Deposits prepared By Flame Spray Processing of Liquid Precursors", Nanostructured Materials, vol. 8, No. 1, (1997) pp. 61–74 (No month date).

Karthikey AN J et al: "Plasma Spray synthesis of nanomaterial powders and deposits", Materials Science and Engineering, A238 (1997) pp. 275–286. (No month date).

Karthikey AN J et al: "Preparation of Nanophase Materials by Thermal Spray Processing of Liquid Precursors", Nanostructured Materials, vol. 9 (1997) pp. 137–140 (No month date).

* cited by examiner

NANOSIZE PARTICLE COATINGS MADE BY THERMALLY SPRAYING SOLUTION PRECURSOR FEEDSTOCKS

CROSS REFERENCE TO RELATED APPLICATION

This application is a Continuation-In-Part of application Ser. No. 09/019,061, filed Feb. 5, 1998, issued as U.S. Pat. No. 6,025,034 by Strutt et al. which is a continuation of application Ser. No. 08/558,133 filed Nov. 13, 1995, now abandoned.

BACKGROUND OF THE INVENTION

1. Field of the Invention

This invention relates to a thermal spray process which uses solution precursors as a feedstock.

2. Description of the Related Art

Coatings are commonly used to provide desirable surface properties of the underlying bulk substrates. Examples of protective coatings include wear-resistant, corrosion-resistant and thermal barrier coatings. In many applications, multiple properties of the coatings are often desirable. However, it is not always possible to have a single material (single phase material, alloy or composite) that has all the required properties. In such a case, multiple materials with different properties can be used in the form of multilayers.

Conventional coatings, including multilayered coatings, are made of coarse-grained materials with grain sizes which are greater than several microns. These coatings can be prepared by solution chemistry, physical or chemical vapor deposition or thermal spraying. For deposition methods that do not involve solution based chemistry, physical vapor methods such as sputtering and beam induced evaporation are commonly used. The vapor of the materials (as atoms or clusters) condense on the substrate to form coatings. The chemical vapor approach generally involves pyrolysis of chemical precursors at the substrate to form desirable reaction product coatings. Vapor techniques are generally suitable for preparing thick films or thin coatings due to the low rate of deposition.

An alternative approach to fabrication of thick coatings is thermal spraying. In thermal spraying powders are generally used as the feedstock and fed into a flame aimed at the surface of substrates. The powders are propelled in the gas flow and are fused to form coatings on the substrate. Thermal spraying includes plasma methods in the ambient atmosphere or vacuum, high velocity oxyfuel spraying or high velocity impact fusion spraying. In all cases, the feedstock are often very coarse agglomerates of powders. The agglomerate size is typically in the tens of microns. The powder agglomerates often form splat microstructures, which are pancake-like structures in the thermally sprayed coatings.

Although thermal spraying is a viable approach to preparing thick coatings, the use of the powder agglomerate feedstock has limitations and problems. First, the sprayable powders often require reprocessing from the parent powders by controlled agglomeration, which adds more cost to the production and often introduces impurities if surface-active precursors are used as binders. Second, the splat boundaries in the as-sprayed coatings are often the initiation sites for flaw propagation that consequently lead to mechanical failure of the coatings. Third, the as-formed splat microstructures present a limitation on the scale of chemical homogeneity and mixing of multiphasic materials when desired because the splat is at least greater than several microns thick, due to the flattening of the molten particles on impact. From commercial experience, sprayable powders need to be of a certain size such as about 30 microns or larger for efficient deposition. As a result, reconstitution of nanoscale powder to 30 micron-sized agglomerates is often required. Unfortunately, these larger diameter agglomerates produce longer splat microstructures in the coating. These large splat particles become a serious problem when multifunctional applications require multilayered, hybrid coatings with fine, continuous interfaces, since the length scale of an interface is limited by the splat microstructure.

To solve this fine gradient coating problem, we proposed to use liquid solutions wherein the composition of the solution is varied as the coating is applied. Although it has been known to use a liquid feedstock in thermal spraying, such disclosures do not relate to the production of nanostructure coatings and the multilayer and gradient coatings of the present invention.

U.S. Pat. No. 5,032,568 to Lau et al uses an atomized aqueous solution containing at least 3 metal salts precursors into an inductively coupled ultra high temperature plasma for coating. There is no discussion of forming nanostrucure coatings nor of how to provide multilayer and gradient coatings on such a small scale.

U.S. Pat. No. 4,982,067 to Marantz et al relates to an apparatus to eliminate the long-standing problems with radial feed plasma spray apparatus by designing a true axial feed in a plasma spray system. While most of this disclosure is to using particles as the feed, at column 5, lines 51–55, the patent states that "alternatively, the feedstock may be in liquid form, such as a solution, a slurry or a sol-gel fluid, such that the liquid carrier will be vaporized or reacted off, leaving a solid material to be deposited." Again, there is no discussion of forming nanostructure coatings nor of how to provide multilayer and gradient coatings on this small scale. In addition this patent essentially deals with the deposition of solid particles that are formed by conversion of the droplets to solid particles in flight before impacting the substrate.

U.S. Pat. No. 5,413,821 to Ellis et al relates to an inductively coupled plasma to thermally decompose a chromium bearing organometallic compound. Column 2, lines 19–22, states that the organometallic compound can be introduced to the plasma as a vapor or a solid. However, in Example 4 the tetramethylchromium is cryogenically cooled to the liquid state for application to the plasma coating device. The organometallic liquid was introduced into the plasma by bubbling through a carrier gas or in the form of solid powder entrained in the carrier gas. The former may actually exist in the form of chemical vapor. Again, there is no discussion of forming nanostructure coatings nor of how to provide multilayer and gradient coatings on this small scale.

U.S. Pat. No. 5,609,921 to Gitzhofer et al discloses a suspension plasma spray where a suspension of particles of the material to be deposited is in a liquid or semi-liquid carrier substance. An inductively coupled radio-frequency plasma torch is used. The preformed particles are suspended in a liquid carrier. Vaporization of the liquid carrier in the plasma leads to the agglomeration of the particles. The particles become molten and impact the substrate. Suspension of small particles in a liquid and its subsequent spraying into the plasma flame may lead to an additional problem. If the particles are dispersed and are very fine (such as less than 100 nm), they may not have enough momentum to penetrate into the plasma flame and be carried by the plasma flame to the substrate. Again, there is no discussion of forming nanostructure coatings nor of how to provide multilayer and gradient coatings on this small scale.

SUMMARY OF THE INVENTION

It is an object of this invention to use of solution precursors as feedstock in thermal spraying of ceramic, metallic, organic and hybrid (a combination of various classes of materials) coatings in a potentially competitive, single step fabrication process for coatings.

It is a further object of this invention to provide a thermal spray process which eliminates the need to synthesize powders and reprocess these powders for spraying.

It is a further object of this invention to utilize the chemical conversion of droplets in a thermal spray process to form desirable reaction products as coatings on substrates in a single step synthesis process.

It is a further object of this invention to provide a thermal spray process in which solution feedstocks are employed for better homogeneity and mixing of multiphasic materials.

It is a further object of this invention to reduce costs for preparing coatings of high melting temperature materials by replacing the melting of the powder required in conventional thermal spray of powder feedstock with the lower temperature solidification of thermally sprayed droplets at the substrate.

It is a further object of this invention to utilize the molecular design of solution precursors for desirable reaction products in a thermal spray process.

It is a further object of this invention to utilize an external energy source simultaneously during the thermal spraying to affect the molecular design, structure, microstructure and interfaces of the coating.

It is a further object of this invention to utilize a post deposition application of an external energy source to further affect the molecular design, microstructure and interfaces of the coating.

It is a further object of this invention to employ a thermal spray process with a solution feedstock in which the droplet size is varied.

It is a further object of this invention when using a thermal spray process with a solution feedstock to further reduce droplet size by placing a fine screen mesh between the spray nozzle and the substrate.

It is a further object of this invention when using a thermal spray process with a solution feedstock to control the residence time, the in-flight temperature of droplet, and the working distance to the substrate to control the structure and the microstructure of the deposited coatings.

It is a further object of this invention to employ a thermal spray process in which fine droplets are allowed to solidify before reaching the substrate by controlling the in-flight temperature so that the resulting splat will have a smaller dimension compared to that obtained by using a powder feedstock.

It is a further object of this invention to employ a thermal spray process in which droplets are allowed to reach the substrate in the liquid state so that solidification of droplets at the substrate will also lead to finer splat microstructure and better chemical mixing when more than a single phase of materials are sprayed.

It is a further object of this invention to employ a thermal spray process that is suitable for producing multilayered materials that require fine scale grading, both compositionally and microstructurally, and particularly for nanostructured graded materials.

It is a further object of this invention to employ a thermal spray process which permits the integration of layers by gradually graded interfaces rather than abrupt interfaces so as to permit the compatibility of hybrid multilayered materials, i.e. ceramics-ceramics; metal-ceramics; metal-metal, organic-inorganic; and in any combination.

It is a further object of this invention to employ a thermal spray process which permits microstructural, structural and chemical grading with continuous interfaces at a fine scale.

It is a further object of this invention to employ a thermal spray process in which the process can be adapted to contain nanostructured preformed particles in solution so that the solution provides the percolating matrix whereas the powders provide the major constituents of the coating layers.

These and further objects of the invention will become apparent as the description of the invention proceeds.

It has now been found that thin films or coatings can be made of nanostructured particles which have a particle size less than 100 nm (i.e. 0.1 micron) by thermally spraying a solution of a liquid coating precursor feedstock onto a substrate to form the film or coating. The resulting thin film or coating has a thickness of about 100 nanometers or larger. By using thermal spraying with different precursor feedstock solutions, coatings can be made with more than one layer. Within a given layer, by varying the composition of the precursor feedstock, a composition gradient coating can be formed having nanoparticle size particles of less than 100 nm. Many combinations of materials can be co-deposited, such as ceramics-ceramics, metal-ceramics, metal-metal, and organic-inorganic. By applying an external energy source either during the coating process or during post deposition, the resulting coating can be modified.

A further feature of the invention is that multifunctional, multilayered, nanostructured coatings can be better prepared by using solution feedstocks in the thermal spray deposition process. This permits tailored engineering of the interfaces at a finer length scale by compositional and microstructural grading throughout the entire coating thickness. This process permits an efficient conversion of molecules-atoms (solution dependent) into aerosol droplets and subsequent chemical reactions to form the product layers on the substrate. With post-deposition treatment of the as-synthesized coating, there can be optimized microstructures, structures, density and adhesion.

By using thermal spraying of solution precursor feedstocks, compositionally and microstructurally graded coatings are fabricated which have unique advantages. The molecular level mixing of the constituents in solution precursor feedstocks allows for better chemical homogeneity of sprayed products. By using fine droplets that are many times smaller than the conventionally used powder feedstock (e.g. 30 microns or larger in particle size), a finer scale of microstructure can be achieved. The solidification of droplets can be controlled in flight or on impact on the substrate by controlling the spray temperature, the working distance and the substrate temperature. This provides a means to reduce the size of microstructure as compared to the powder feedstock routes. Finally, functional grading of multilayered coatings can be achieved at a much finer scale, particularly for nanostructured graded coatings, both compositionally and microstructurally, compared to the powder feedstock approach wherein the size of splat poses a limit on the scale of mixing and grading. Functional grading may include, but is not limited to, the graded continuous interface where the microstructure, structure and chemistry of two or more materials are varied continuously. Such grading may enhance the thermal, chemical and mechanical stability of multilayerd coatings and the control of the mechanical, electrical, magnetic and other transport properties.

DESCRIPTION OF THE PREFERRED EMBODIMENTS

Figure 1:
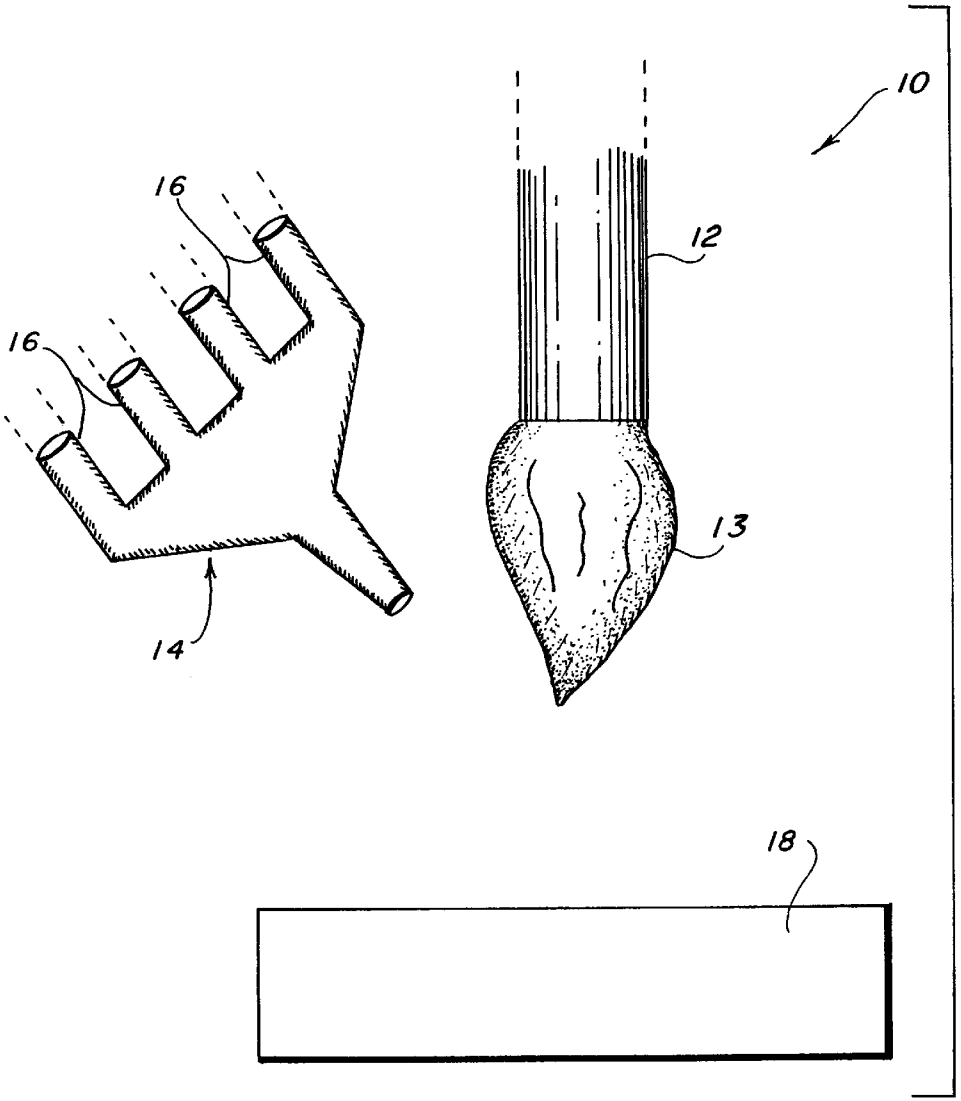
FIG. 1 illustrates a schematic diagram for the coating process.

As shown schematically in FIG. 1, a thermal spray coating apparatus such as the Metco 9MB-plasma torch can be fitted with a GH nozzle, and the powder injection port is removed and replaced with multiple injection nozzles which are incorporated and arranged with para-axial or oblique angle injection into the plasma flame. As seen in FIG. 1, the thermal spray gun 10 has a flame generating tube 12 from which the flame 13 extends. Adjacent the flame is the liquid supply chamber 14 which will direct the liquid into the flame. The multiple injection nozzles 16 in the chamber 14 permit controlled and varying amounts of the various component feedstock solutions to be applied to the plasma spray gun. The coating mixture is then sent through the flame and onto the substrate 18. This setup can be mounted on a 6-axis GM-Fanue robot. A high-pressure chemical metering pump can be used to feed the solutions to the nozzles. Preferably, the primary and secondary arc gases are argon and hydrogen respectively, and the atomization gas is nitrogen.

Deposition of ceramic coatings using solution feedstocks can be made with coatings greater than or equal to 40 microns thick of alumina, zirconia, yttria stabilized zirconia, as well as compositionally graded alumina-zirconia-alumina and graded alumina-yttria stabilized zirconia on stainless steel substrates. The feedstocks include aqueous solution of aluminum nitrate, alcohol-water solution of aluminum tri-sec butoxide, alcohol-water solution of zirconium n-propoxide, and alcohol-water solution of yttrium nitrate and zirconium n-propoxide. Thinner coatings can also be made by running a fewer number of thermal spray passes over the substrate. The solution precursors may include organometallic, polymeric, and inorganic salts materials, which should be cost efficient for a particular deposition. Preferred inorganic salts are nitrates, chlorides and acetates.

Adherent and smooth coatings can be prepared, depending on the specific deposition conditions such as spray working distance. Characterization of coatings' structure, microstructure, and adhesion included analysis by x-ray diffraction, scanning electron microscopy and energy dispersive spectroscopy.

Post deposition techniques may include conventional furnace heat treatment, UV lamp, laser, microwave, and other beam sources at various wavelengths. The post deposition techniques may also be employed simultaneously, or in sequence, during cycles of thermal spraying of the liquid precursors, so as to control the microstructure, structure, chemistry and interfaces properties, and porosity etc.

Figure 2:
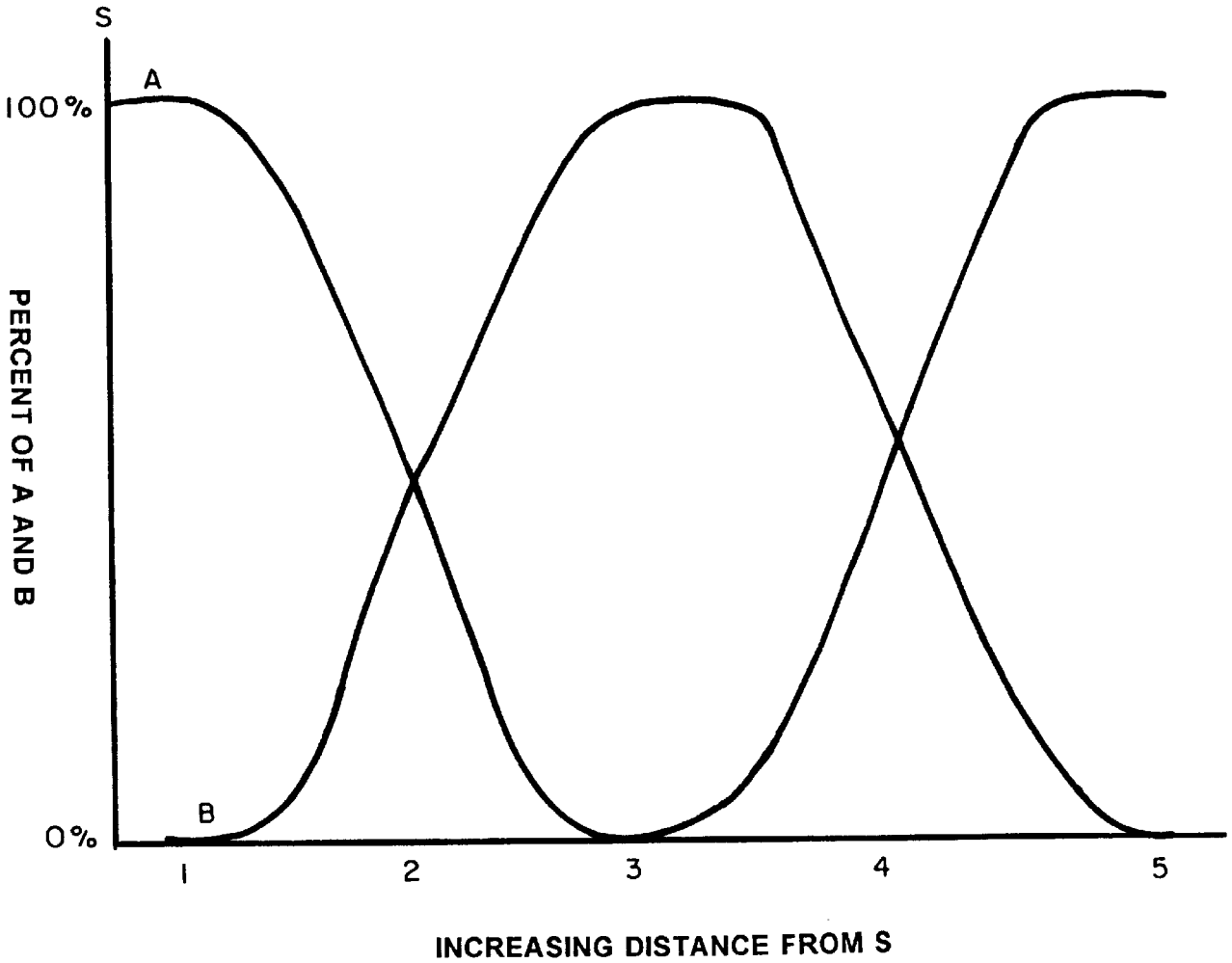
FIG. 2 illustrates a gradient coating in the form of a graph showing the relative concentrations of the two components A and B as a function of the distance from the substrate S.

FIG. 2 illustrates a substrate, S, on the left to which a coating of components A and B have been added as a gradient coating. The two curved lines indicate the % of each component in the total coating at each height above the substrate. Initially, at the substrate surface, the only coating component is A and the amount of B is zero. Then as the spray coating continues to build up the coating, more of B is added until, when the height in region 2 is reached, the concentration of each component is about the same. This trend of increasing the relative amount of B continues until at region 3, the composition is all B. Finally, the third coating layer is built by increasing the A component until it is all A in region 5.

FIG. 2 illustrates how the gradient can be finely controlled to change from one composition to another by using the solution precursors. The three component layer shown in FIG. 2 also illustrates how the three layers can be built up with good adherence between the layers due to the gradient transition between them. When coating A is alumina, it provides good adherence to the substrate. When coating B is zirconia, it provides thermal resistance properties. By applying a second layer of A of alumina, it provides oxygen protection to the intermediate zirconia layer. Such a concept of graded coatings can be used in other applications as well and by using other materials.

As seen in FIG. 1, the thermal spray apparatus can have a series of injection nozzles in the spray gun mechanism to deliver the various combination of liquid coating components. Alternative spraying devices could be used in which two spray guns could be positioned side by side to deliver two separate compositions, or other combinations of multiple guns can be used.

In another embodiment, it is possible to add small preformed particles to the liquid feedstock solution as suspended particles. When co-spraying the suspended particles together with the same liquid carrier, it is preferred to add a surfactant which allows the nanostruuctured particles to be somewhat agglomerated to only a few microns, but definitely smaller than the conventional 30 or larger micron agglomerate size. This embodiment is useful when applying materials that are not stable in the liquid state, or when applying two components A and B where they would be undesirably reactive in the liquid state while they were being applied.

By using the process of this invention, the coating artisan is given the capability of making thin or thick coatings which are made of nanostructured particles which have a diameter of less than about 100 nm (0.1 micron). Each layer can be as thin as about 100 nm, but the particle size (or crystallite size) in, each layer must be less than 100 nm.

Conventional thermal spraying of thick coating will only give particles of at least several microns in one dimension, i.e. the thickness of the splat. Even electroplating is not a straight forward procedure for grading, since the conductivities of different species vary normally, and thus result in non-stoichiometric deposition.

EXAMPLES

Having described the basic aspects of the invention, the following examples are given to illustrate specific embodiments thereof.

Example 1

This example illustrates the production of a multilayer coating according to the present invention.

The following solutions were used as the feedstocks: 0.5 M aluminum nitrate (AN); 0.5 M aluminum tri-sec- butoxide (ASB); 0.5 M zirconium n-propoxide; and 0.5 M zirconium n-propoxide with 4 wt % yttria. The alkoxide solutions were made by dissolving the alkoxide in an ethanol-acetic acid solution and then adding water. The aluminum nitrate solution was prepared by dissolving the appropriate amount of the salt in distilled deionized water. The nitrate has the advantage of being very inexpensive, and there are no undesirable secondary reactions. However, the nitrate has been suggested to interfere with the stabilization of zirconia, and if large amounts of solution are used the $NO_x$ (x=1, 2) from the decomposition of the nitrate may be a problem. The alkoxide, on the other hand, is more expensive as compared to the nitrate (but the amount of alumina is not the major component) and the alkoxide is reactive with water. It has been shown to stabilize zirconia at 10%.

The graded sample was prepared by spraying 20 passes of the aluminum nitrate solution, stopping and then running distilled water through the line to remove the AN solution. This was sprayed into a bucket and not on the substrate. Then, the solution was changed to zirconia (unstabilized) and sprayed until the $ZrO_2$ sol had replaced the water. Then, the plasma was started and the 20 passes were sprayed on the substrate. Again, the system was flushed with water and the AN sol was used again. The result was a graded coating of alumina-zirconia-alumina on a steel substrate as characterized by Run 1a in Table 1. The crystallite size was obtained by x-ray line broadening, and the microstructure by scanning electron microscopy. The chemistry was characterized by energy dispersive x-ray spectroscopy.

TABLE 1

| Run | Solution feedstock | Phase of deposited coatings | Average crystallite size (nm) |
|---|---|---|---|
| 1a | Graded AN-ZP-AN | monoclinic $ZrO_2$ | 19 |
| | | tetragonal $ZrO_2$ | 25 |
| | | alpha alumina | 37 |
| 1b | aluminum nitrate (AN) | gamma alumina | 14 |
| 1c | aluminum sec-butoxide (ASB) | gamma alumina | 67 |
| 1d | yttria stabilized Zr n-propoxide (ZP) | tetragonal $ZrO_2$ | 42 |

For Run 1a, the two alumina layers had an average crystallite size of 37 nm. For the intermediate zirconia layer, there were two phases present.

Additional runs were made with three solutions as set forth in Runs 1b–1d in Table 1. All of the average crystallite sizes were less than 80 nm. The data shows that nanostructured coatings were fabricated.

The difference in the nature of the alumina layer in Runs 1a and 1b is due to the existence of Zr which acts as a thermal barrier. Most of the heat is trapped in the Zr layer, and so it allows a higher temperature phase of alumina to be formed in Run 1a. In Run 1b, most of the heat is conducted away to the substrate so that a low temperature phase of alumina is formed.

Example 2

A systematic investigation of coating parameters was carried out. All solutions were prepared from aluminum nitrate at the molar concentration given in Table 2. Samples were characterized by XRD if the coating adhered to the substrate.

In the following Table 2, the relative plasma temperature was determined by measuring by the current in amperes divided by the gas flow in standard cubic feet per hour. The aluminum nitrate concentration is measured in moles/liter and the speed is in mm/sec. The spray distance is in inches and the term "OOR" indicates that the grain size was "out of range" meaning that it was larger than 100 nm.

TABLE 2

| Sample No. | Plasma Temp (A/SCFH) | particle size | concen-tration | speed | spray distance | Grain Size (nm) | phase | Adhere |
|---|---|---|---|---|---|---|---|---|
| 1a | 6.875 | 0 | 0.5 | 20 | 1.5 | 17 | gamma | Y |
| 1b | 6.875 | 0 | 0.5 | 20 | 2 | 97 | gamma | Y |
| 1c | 6.875 | 0 | 0.5 | 20 | 2.5 | OOR | gamma | Y |
| 1d | 6.875 | 0 | 0.5 | 20 | 3 | | | N |
| 2a | 6.875 | 0 | 1.25 | 1000 | 1.5 | | | N |
| 2b | 6.875 | 0 | 1.25 | 1000 | 2 | | | N |
| 2c | 6.875 | 0 | 1.25 | 1000 | 2.5 | | | N |
| 2d | 6.875 | 0 | 1.25 | 1000 | 3 | | | N |
| 3a | 6.875 | 35 | 0.5 | 1000 | 1.5 | | | N |
| 3b | 6.875 | 35 | 0.5 | 1000 | 2 | | | N |
| 3c | 6.875 | 35 | 0.5 | 1000 | 2.5 | | | N |
| 3d | 6.875 | 35 | 0.5 | 1000 | 3 | | | N |
| 4a | 6.875 | 35 | 1.25 | 20 | 1.5 | | | N |
| 4b | 6.875 | 35 | 1.25 | 20 | 2 | | | N |
| 4c | 6.875 | 35 | 1.25 | 20 | 2.5 | | | N |
| 4d | 6.875 | 35 | 1.25 | 20 | 3 | | | N |
| 5a | 8.125 | 0 | 0.5 | 1000 | 1.5 | 29 | Gamma | Y |
| 5b | 8.125 | 0 | 0.5 | 1000 | 2 | | | N |
| 5c | 8.125 | 0 | 0.5 | 1000 | 2.5 | | | N |
| 5d | 8.125 | 0 | 0.5 | 1000 | 3 | | | N |
| 6a | 8.125 | 0 | 1.25 | 20 | 1.5 | OOR | alpha | Y |
| 6b | 8.125 | 0 | 1.25 | 20 | 2 | 135 | alpha | Y |

TABLE 2-continued

| Sample No. | Plasma Temp (A/SCFH) | particle size | concen-tration | speed | spray distance | Grain Size (nm) | phase | Adhere |
|---|---|---|---|---|---|---|---|---|
| | | | | | | 18 | gamma | |
| 6c | 8.125 | 0 | 1.25 | 20 | 2.5 | 15 | gamma | Y |
| 6d | 8.125 | 0 | 1.25 | 20 | 3 | 37 | gamma | Y |
| 7a | 8.125 | 35 | 0.5 | 20 | 1.5 | 28 | gamma | Y |
| 7b | 8.125 | 35 | 0.5 | 20 | 2 | | | N |
| 7c | 8.125 | 35 | 0.5 | 20 | 2.5 | 30 | gamma | Y |
| 7d | 8.125 | 35 | 0.5 | 20 | 3 | 30 | gamma | Y |
| 8a | 8.125 | 35 | 1.25 | 1000 | 1.5 | | | N |
| 8b | 8.125 | 35 | 1.25 | 1000 | 2 | 38 | gamma | Y |
| 8c | 8.125 | 35 | 1.25 | 1000 | 2.5 | | | N |
| 8d | 8.125 | 35 | 1.25 | 1000 | 3 | 37 | gamma | Y |

Qualitative observations can be made from the data in Table 2. First, the adhesion of the liquid coating is generally better than when spraying the particles themselves because the particles did not have enough thermal energy to form a true bonding with the substrate or with themselves under the same conditions as the liquid spray. Second, the table demonstrates the need for careful control of parameters to optimize the coating.

Example 3

Investigation of grading composition was carried out using six premixed solutions of aluminum sec butoxide (ASB) and zirconium n-propoxide (ZP), using volume ratios of a total volume of 100 mL as set forth in Table 3.

TABLE 3

| Coating | ASB % | ZP % |
|---|---|---|
| 1 | 100 | 0 |
| 2 | 90 | 10 |
| 3 | 70 | 30 |
| 4 | 50 | 50 |
| 5 | 30 | 70 |
| 6 | 10 | 90 |

The deposition time (t) (as measured by the time the solution was passed through the gun) and the working distance (D) between the gun and substrate were investigated and the results are set forth in Table 4.

TABLE 4

| Run No. | Time & distance | Phase(s) detected Major phase listed first | Average Crystallite Size (nm) |
|---|---|---|---|
| 1 | t: 1 min | Tetragonal $ZrO_2$ | 12 |
| | D: 1" | Monoclinic $ZrO_2$ | 8 |
| | | alumina | 2 |
| 2 | t: 1 min | Tetragonal $ZrO_2$ | 21 |
| | D: 2" | Monoclinic $ZrO_2$ | 17 |
| | | alumina | 15 |
| 3 | t: 1.5 min | Tetragonal $ZrO_2$ | 20 |
| | D: 1" | Monoclinic $ZrO_2$ | 19 |
| | | alumina | 43 |
| 4 | t: 1.5 min | Tetragonal $ZrO_2$ | 10 |
| | D: 2" | alumina | 4 |
| 5 | t: 2 min | Monoclinic $ZrO_2$ | 58 |
| | D: 1" | Tetragonal $ZrO_2$ | 59 |
| | | alumina | 13 |
| 6 | t: 2 min | Tetragonal $ZrO_2$ | 17 |
| | D: 1.5" | Monoclinic $ZrO_2$ | 14 |
| | | alumina | 45 |

TABLE 4-continued

| Run No. | Time & distance | Phase(s) detected Major phase listed first | Average Crystallite Size (nm) |
|---|---|---|---|
| 7 | t: 2 min | Tetragonal $ZrO_2$ | 11 |
| | D: 2" | alumina | 11 |

The alumina phase matches JCPDS card 37-1462 (from coprecipitated mixture at 500° C.). This may suggest that nucleation of low temperature alumina phase at the surface of substrate, which is different form the high temperature deposition of molten alumina particles in conventional thermal spraying.

It is understood that the foregoing detailed description is given merely by way of illustration and that many variations may be made therein without departing from the spirit of this invention.

What is claimed is:

1. A method of forming a film or coating made of nanostructured particles having a particle size less than 100 nm comprising thermally spraying a solution of a liquid coating precursor feedstock onto a substrate to form said film or coating wherein said film or coating has a thickness of about 100 nm or larger.

2. A method according to claim 1, wherein the film or coating is made of more than one layer by thermally spraying different precursor feedstock solutions.

3. The method of claim 2, wherein the different precursor feedstock solutions are sequentially applied in the same thermal plasma spray apparatus.

4. The method of claim 1, wherein the composition of the precursor feedstock is varied to form a composition gradient coating having nanoparticle size particles of less than 100 nm.

5. A method according to claim 1, wherein the film or coating materials are selected from the group consisting of ceramics-ceramics; metal-ceramics; metal-metal, organic-inorganic and mixtures thereof.

6. The method of claim 1, wherein an external energy source is applied during the coating process or during a post deposition period to modify the coating.

7. The method of claim 1, wherein the temperature of the thermal spraying is controlled so that the liquid feedstock is not vaporized before it reaches the substrate.

8. The method of claim 1, wherein the coating precursor feedstock is selected from the group consisting of an aqueous solution of aluminum nitrate, an alcohol-water solution of aluminum tri-secbutoxide, and alcohol-water solution of zirconium n-propoxide, an alcohol-water solution yttrium nitrate and zirconium n-propoxide, and mixtures thereof.

9. The method of claim 1, wherein the coating precursor feedstock further comprises suspended particles.

10. A method according to claim 9 wherein the suspended particles are nanostructured particles.

11. The method of claim 10, wherein the coating precursor feedstock further comprises a surfactant to allow the nanostructured particles to be somewhat agglomerated to only a few microns.

12. The method of claim 1, wherein the droplet size of the solution feedstock is controlled and varied.

13. The method of claim 12, wherein the spraying is by means of a thermal plasma spray apparatus and wherein the droplet size is reduced by placing a fine screen mesh between said thermal plasma spray apparatus and the substrate.

14. The method of claim 1, wherein the residence time, the in-flight temperature of droplet, and the working distance to the substrate are controlled to control the structure and the microstructure of the deposited coatings.

15. The method of claim 1, wherein the spraying is controlled so that fine droplets are allowed to solidify before reaching the substrate by controlling the in-flight temperature whereby the resulting splat will have a smaller dimension compared to that obtained by using a powder feedstock.

16. The method of claim 1, wherein the spraying is controlled so that the droplets are allowed to reach the substrate in the liquid state whereby solidification of droplets at the substrate will lead to finer splat microstructure and better chemical mixing when more than a single phase of materials are sprayed.

* * * * *